United States Patent [19]

Ramseier

[11] Patent Number: 4,687,090

[45] Date of Patent: Aug. 18, 1987

[54] COIN GUIDE HAVING TRACK SECTIONS ARRANGED IN ZIG ZAG FORM

[75] Inventor: Hans Ramseier, Gumligen, Switzerland

[73] Assignee: Autelca AG., Gümligen, Switzerland

[21] Appl. No.: 769,501

[22] Filed: Aug. 26, 1985

[30] Foreign Application Priority Data

Aug. 29, 1984 [CH] Switzerland ..... 4134/84

[51] Int. Cl.[4] ..... G07F 3/02

[52] U.S. Cl. ..... 194/317; 194/345; 194/349; 194/351

[58] Field of Search ..... 194/203, 344, 345, 346, 194/347, 348, 349, 317, 318, 319, 202, 351; 193/27, DIG. 1; 133/3 R, 3 C

[56] References Cited

U.S. PATENT DOCUMENTS

| | | | |
|---|---|---|---|
| 553,361 | 1/1896 | Root | 194/344 |
| 1,304,937 | 5/1919 | Bozic | 133/3 C |
| 1,317,953 | 10/1919 | Bodmer | 194/344 |
| 2,277,018 | 3/1942 | Patzer et al. | 194/345 X |
| 2,279,488 | 4/1942 | Patzer et al. | 194/345 X |
| 2,288,835 | 7/1942 | Patzer et al. | 194/345 X |
| 2,292,472 | 8/1942 | Patzer et al. | 194/345 X |
| 3,163,278 | 12/1964 | Rounsivell | 194/345 X |
| 3,870,137 | 3/1975 | Fougere | 194/317 |
| 4,106,608 | 8/1978 | Dietz | 194/345 |
| 4,353,452 | 10/1982 | Shah et al. | 194/317 |
| 4,410,077 | 10/1983 | Okolischon | 194/344 |

FOREIGN PATENT DOCUMENTS

| | | | |
|---|---|---|---|
| 2075960 | 11/1981 | United Kingdom | 193/DIG. 1 |

*Primary Examiner*—Joseph J. Rolla
*Assistant Examiner*—Edward S. Ammeen
*Attorney, Agent, or Firm*—Brady, O'Boyle & Gates

[57] ABSTRACT

The coins roll along track surfaces (1, 2, 3) merely supporting the bottoms of the coins, these track surfaces each being associated with respectively one steep guide surface supporting the coins along one side. The guide surfaces are formed on plates (11, 19, 24) that can be spread apart by pivoting. Beside the end of a first track surface (1) oriented toward a baffle surface (8), a second track surface (2) begins that extends in the opposite direction, on which the coins roll into a steadying chamber (15) having a V-shaped bottom cross section (35, 36), from which emanates a third track surface (3) on which the previously steadied coins pass through a coin checking station (20) at a velocity independent of the speed with which the coins have reached the steadying chamber (15).

Foreign bodies inserted in the coin guide that do not drop over the edge of the first track surface (1) lying in opposition to the guide surface (4) associated therewith, and that get caught or stuck on the second or third track surface (2, 3), can be released by spreading the plates (11, 19, 24) apart by pivoting them relative to each other so that the foreign bodies drop down. Auxiliary objects introduced for abuse of the coin guide jut into empty space in the area in front of the guide surface (4) associated with the first track surface (1) and cannot pass the reversing point of the track surface (1, 2) at the baffle surface (8) and can thus cause practically no damage.

13 Claims, 3 Drawing Figures

Fig. 1
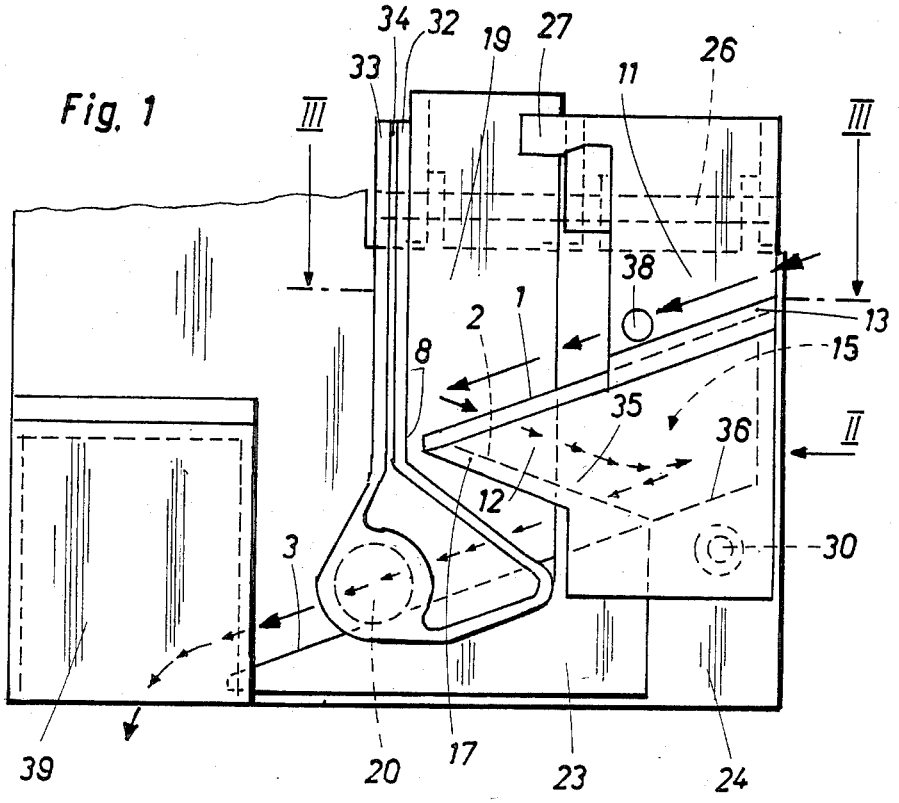
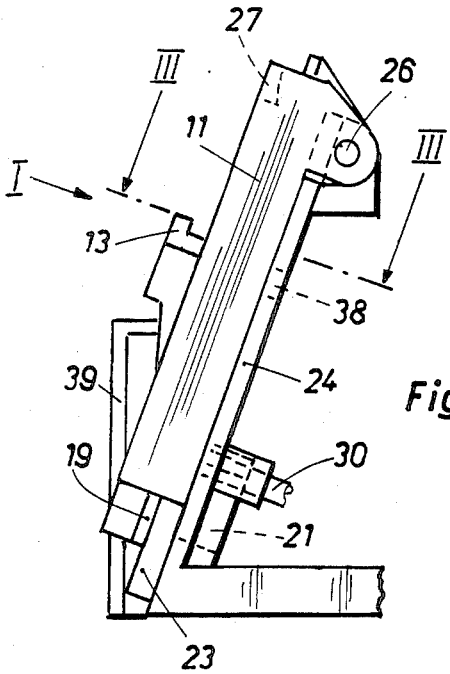
Fig. 2
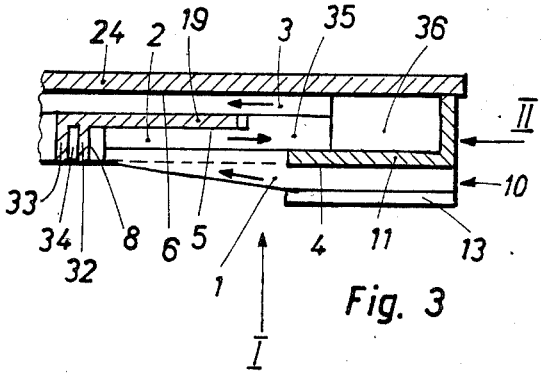
Fig. 3

COIN GUIDE HAVING TRACK SECTIONS ARRANGED IN ZIG ZAG FORM

The invention relates to a coin guide, especially for automats providing a service upon dropping in coins, for example establishment of a telephone connection, dispensing of goods, or issuance of coins when designed as coin changers.

BACKGROUND OF THE INVENTION

Such automats are exposed to intentional interference and material damage, which can be vandalism or can arise due to manipulations with the attempt to obtain the service of the automat without previous insertion of coins or to seize coins previously dropped in by third parties or even coins already collected by the automat. Thus, a foreign body, especially, for example, a folded piece of paper, is pushed into the coin channel, which piece of paper, when third parties thereafter drop in coins, is ever further pushed along in the coin channel. Also, attempts are made initially to force the foreign body maximally far into the coin channel by means of a wire, a thin, elastic saw blade or another auxiliary means, so that many coins can accumulate. Later on, the attempt is then made to fish the coins out of the coin channel with the aid of such auxiliary means. Also, by introducing such auxiliary means, attempts are made to interfere with the coin checker and/or its control device, with the intent to effect issuance of coins stored in the automat. Such manipulations are to the disadvantage of the entity interested in the performance of the automats, lead to operating disturbances of the automat which must be remedied by servicing personnel, and—if auxiliary means are used for manipulations—lead to damages with the consequence of expensive repairs. As compared with the thus-caused expenses, loss by coins obtained through misuse normally is less significant, but even this loss can be appreciable, if attempts at emptying one or even several coin vaults are successful.

SUMMARY OF THE INVENTION

The invention solves the problem by providing a coin guide wherein introduced foreign bodies do not lead to clogging, the insertion of auxiliary means of the aforementioned type remains unsuccessful, and damages by such auxiliary means are practically avoided.

The advantages attained by the invention are to be seen essentially in that foreign bodies drop over the edge of the track surface in opposition to the guide surface, and auxiliary means introduced for abusive manipulations, as mentioned above, will jut out "into emptiness" into the space in front of the guide wall. When sliding along the track surface or along the guide surface, these auxiliary means can hardly cause any damage. Access to the coin checker cannot be obtained by auxiliary means of the aforementioned type, because the coins, at the end of a first track section, bounce off a baffle wall, continue rolling, after this reversal of direction, along a second track section, and only thereafter pass to the coin checker. The reversal of direction cannot be followed even by a flexible auxiliary means, such as, for example, a wire segment, and the second track section cannot be reached if it extends along the rear face of a wall, the front face of which forms the guide surface for the first track section. On account of the reversal of direction, successive track sections can be provided on the walls of parallel plates, the faces of which constitute guide surfaces. By mounting the plates to be pivotable, coins or foreign bodies jammed in between them can be eliminated by spreading the plates apart, the thus-occurring vibration also promoting the release of stuck coins or foreign bodies. The spreading-apart step can be performed by a push button to be operated in case of trouble. Also during maintenance work, the track sections are conveniently accessible, during which step the plates could be spread apart or pivoted apart even more. Due to the fact that a track section leads from a steadying chamber for the coins to the coin checker, the objective is attained that all coins pass through the (usually electronic) coin checker at the same, desired speed, independently of the velocity with which they were dropped in.

BRIEF DESCRIPTION OF THE DRAWINGS

The invention will be described in greater detail below with reference to the drawings showing merely one embodiment. In the drawings:

FIG. 1 is a coin guide in the viewing direction I in FIGS. 2 and 3,

FIG. 2 is a view in direction II in FIGS. 1 and 3, and

FIG. 3 is a section along line III—III in FIGS. 1 and 2.

DESCRIPTION OF THE PREFERRED EMBODIMENT

The illustrated coin guide exhibits, in three track sections following one another in zig-zag mode, respectively one track surface 1, 2 and 3, respectively, supporting the coins, with a slope. Each of these track surfaces is associated with a steep incline guide surface 4, 5 and 6, respectively, supporting the coins on one side. The gradient of the track surfaces 1, 2, 3 and the steepness of the guide surfaces 4, 5, 6 are dimensioned so that the coins roll along the track surfaces while supportively leaning on and sliding along the guide surfaces 4, 5, 6.

The first track section with the track surface 1 emanates from the coin insert slot at the top thereof, not shown, and is oriented downnwardly toward a baffle surface 8. The track surface 1 is formed by the top surface of a strip-like extension 10 on the side of a plate 11 at the front in the viewing direction I, and, in part, by the top end face, lying in the plane of the plate, of a triangular projection 12 of the plate 11. A portion of the front face of the plate 11, having a spacing from the baffle face 8 exceeding the coin diameter, is associated with the track surface 1 as the guide surface 4. To prevent a coin from being pushed through the coin slot in a direction pointing away from the guide surface 4, in which case the coin would drop over the forward edge of the track surface 1, a partial section of the track surface 1, emanating from the coin insert slot, exhibits a guide rim 13 lying in opposition to the guide surface 4.

The second track section with the track surface 2 guides a coin that has rebounded from the baffle surface 8 into a smoothing chamber 15. The track surface 2 is formed by the top surface of a strip-like extension 17 at the lower rim of the triangular projection 12 on the rear face of the plate 11; the front face of a second plate 19 is associated therewith as the guide surface 5.

The third track section with the track surface 3 emanates from the steadying chamber 15 and leads between the coils 20 (FIG. 1) and 21 (FIG. 2) of a coin checker, not shown in detail, to the end of the coin guide where the coins drop down to a coin gate, not shown, controlled by the coin checker. The track surface 3 is constituted by the top sloping end face of a plate 23 attached to the front side of a plate 24. The track surface 3 is associated with the front side of the plate 24 as the guide surface 6.

The three plates 11, 19 and 24 are retained in parallel at spacings respectively corresponding to the width of the track surfaces 1, 2 and 3. The plate 24 is arranged fixedly and steeply inclined from the horizontal. The plates 11 and 19 are joined to the plate 24 at the top to be pivotable about an axle 26. The plate 19 is maintained at the spacing of the track surface width from the plate 24, in that its lower part contacts the front face of plate 23; and the plate 11 is held at the spacing of the track surface width from the plate 19, in that it partially contacts the plate 19. The plate 11 has an extension 27 above the axle 26, this extension reaching in front of the plate 19 and, in the rest position of plates 11 and 19, having a spacing from the latter to entrain the plate 19 when the plate 11 is pivoted by a certain angle and is then further pivoted. Thereby, during pivoting of the plate 11, a wedge-shaped interspace is created first between the plates 11 and 19 and then between the plates 19 and 24. A plunger 30, which is operable, for example, by means of an angle lever by means of a push button provided to eliminate trouble, serves for pivoting the plate 11, the plunger acting on the rear side of this plate 11.

The baffle surface 8 is formed by one side of a rib 32 projecting from the front side of the plate 19. The rib 32, together with a rib 33, defines a channel 34 for the connecting lines of the coin checker coil 20.

The smoothing chamber 15 is defined at the front by the rear side of the plate 11 and at the rear by the front side of the plate 24, and at the bottom has two bottom surface parts 35 and 36. The bottom surface part 35 adjoins the track surface 2, lies in the plane of the latter, and is formed at a rearwardly projecting part of the strip-shaped extension 10 of the plate 11, this extension running up to the plane of the rear side of the second plate 19. The bottom surface portion 36 lies in the plane of the track surface 3, adjoins the latter, and is formed as the top surface of a projection on the rear face of the plate 11, and abuts against the front face of the plate 24. The projection, however, could also extend only up to the plane of the rear face of the second plate 19; the upper end face of an extension of the plate 23 could, in this case, form the rearward portion of the surface 36.

The steepness of the guide surfaces 4, 5, 6 could be 70° from the horizontal, and the gradient of the track surfaces 1, 2, 3 could be 20° from the horizontal, for example. The angle between the track surface 1, 2 or 3 and the associated guide surface 4, 5 or 6, and the angle between the bottom surface portions 35 and 36 of the steadying chamber 15 are suitably somewhat smaller than 90° so that the coins slide reliably along the guide surfaces 4, 5 and 6 and drop just as reliably from the track surface 1 to the track surface 2 and in the smoothing chamber 15 rearwardly onto the track surface 3 and against the guide surface 6. For this purpose, these angles can be 80°–85°, for example. These angles, the steepness of the guide surfaces, and the gradient of the track surfaces depend on the extent of friction of the coins against the guide surfaces 3, 4, 5, the track surfaces 1, 2, 3, and against the bottom surface portions 35 and 36 of the steadying chamber 15, and on the weight of the coins; the most favorable values therefor can be determined empirically. The incline of the track surface 3 is to be dimensioned so that the coins will travel through between the coils 20 and 21 of the coin checker at a speed ensuring a reliable coin checking operation. The slopes of the track surfaces 1, 2 and 3 need not be identical, or be alike but of opposite directions, and the smoothing chamber could also be designed so that the gradient at the entrance is not opposite to the gradient at the exit. The embodiment described with reference to the drawings is advantageous from the viewpoint of space utilization.

In most cases, foreign bodies will drop off from the forward edge of the track surface 1. Paper segments folded in a reverse V-shape which, in the most adverse case enter into a position wherein one leg of the fold is in front of the projection 12 and the other leg is stuck between this projection and the plate 19, will slide off the top edge of the projection 12 if the plunger 30, when required, is operated repeatedly.

A coin introduced through the insert slot rolls along the track surface 1 to the baffle surface 8. During this step, a sensor 38 responds, for example an induction probe, not shown in detail, and effects closing of the insert slot by a slide provided between the insert slot and the coin guide, and maintains this slot closed until the coin checking step has been completed. The coin abuts against the baffle surface 8 and rebounds therefrom. Inasmuch as the coin, during this process, is no longer guided by the guide surface 4, it drops onto the track surface 2 on which it is laterally guided by the guide surface 5 until reaching the steadying chamber 15. In the steadying chamber 15, the coin comes to rest for a short time in a position wherein it rests on the bottom surface portion 35 and the section of the bottom surface portion 36 adjoining thereto. The coin is then no longer supported laterally so that it drops, sliding along the rearward part of the bottom surface portion 36, rearwardly, falling from the rear edge of the bottom surface portion 35 onto the track surface 3 on which it rolls through between the coils 20 and 21 of the coin checker to the end of the coin guide and drops between the plates 24 and 39 to the coin gate, not shown, which is controlled by the coin checker.

I claim:

1. A coin guide, having at least a first (1, 4) and a second runway (2, 5), being arranged in different directions, said first runway (1,4) including a first track surface (1) and a steep guide surface (4) steeply inclined relative to the horizontal for supporting an inserted coin at its circumference and at one of its sides respectively, said first track surface (1) being inclined to the horizontal both in its longitudinal and in its lateral direction and having an upper and a lower longitudinal edge, said steep guide surface (4) extending along an upstream portion of said lower longitudinal edge of said first track surface (1), said first track surface (1) and said steep guide surface (4) being arranged at an inclination and steepness respectively, such that the coin simultaneously rolls along the first track surface and slides along the guide surface, a transition area, at which a coin runs beyond a downstream portion of said lower longitudinal edge of said first track surface (1) and into said second runway (2, 5), the improvement comprising, a space above and alongside of at least a downstream portion of said upper longitudinal edge of said first track surface (1) is completely free, so that a foreign body can drop over said upper longitudinal edge of said first track surface, a baffle surface (8), said first track surface (1) oriented toward said baffle surface (8), said second runway (2, 5) including a second track surface (2) with a gradient in opposition to the gradient of the first track surface (1) for receiving coins that have rebounded from the baffle surface (8), the beginning of said second track surface (2) arranged beside the end of said first track surface (1), said steep guide surface (4) associated with said first track surface (1) arranged on a side of the first track surface (1) facing said second track surface (2), and is spaced from the baffle surface (8) making it possible for a coin to pass over from said first (1) to said second track surface (2); another guide surface (5) associated with said second track surface (2), said another guide surface (5) arranged on a side of said second track surface (2) facing away from said first track surface (1), said second track surface (2) leading into a steadying chamber (15) for coins, a further track surface (3) leading from said steadying chamber (15) to a coin checking station (20, 21), a further guide surface (6) associated with said further track surface (3), two bottom surface portions (35, 36) forming an angle with each other, one bottom surface portion (35) of said two bottom surface portions lying in a plane of said second track surface (2), the other bottom surface portion (36) of said two bottom surface portions lying in a plane of said further track surface (3), and said steadying chamber (15) being defined on one side by said further guide surface (6) associated with the further track surface (3) and by said two bottom surface portions (35, 36) forming an angle with each other.

2. A coin guide as set forth in claim 1, including a first plate (11); a second plate (19); a third plate (24); means (26) hingedly connecting said first, second and third plates; and said steep guide surface (4), said another guide surface (5) and said further guide surface (6) respectively carried by said first, second and third plates.

3. A coin guide comprising, a first plate member (11) having a front face and a rear face, a baffle surface (8), a first track surface (1) connected on the front face of said first plate member (11) and having a gradient oriented toward said baffle surface (8), said first track surface (1) having an upper end adapted to receive an inserted coin and a lower end adjacent said baffle surface (8), a steep guide surface (4) on the front face associated with said first track surface (1), a steadying chamber (15) for coins, a second plate member (19) having a front face, a second track surface (2) having a gradient opposite the gradient of said first track surface (1) connected on the rear face of said first plate member (11) for receiving coins rebounding from said baffle surface (8) and extending into said steadying chamber (15), another steep guide surface (5) on the front face of said second plate member (19) associated with said second track surface (2), a coin checking station (20, 21), a third plate member (24) having a front face, a third track surface (3) having a gradient connected on the front face of said third plate member (24) and extending from said steadying chamber (15) to said coin checking station (20, 21), a further steep guide surface (6) on the front face of said third plate member (24) associated with said third track surface (3), said further steep guide surface (6) defining one side of said steadying chamber (15), two bottom surface portions (35, 36) in said steadying chamber disposed at an angle with each other, one bottom surface portion (35) of said two bottom surface portions lying in a plane of said second track surface (2) and the other bottom surface portion (36) of said two bottom surface portions lying in a plane of said third track surface (3), said other bottom surface portion (36) forming part of said third track surface eminating from said steadying chamber (15), and the gradient of said first (1), second (2) and third (3) track surfaces, and the steepness of said steep guide surface (4), said another steep guide surface (5) and said further steep guide surface (6) being dimensioned so that coins roll along said track surfaces (1, 2, 3) and simultaneously supportingly slide along the steep guide surfaces (4, 5, 6).

4. Coin guide according to claim 3, including an approximately horizontal axle (26), the first (11) and the second (19) plate members supported by said axle (26) at the third plate member (24) above the track surfaces to be pivotable about said axle (26), said axle 26 disposed parallel to the planes of said plate members, a pushing member (30), said first plate member (11) connected to be pivoted by means of said pushing member (30) with respect to the third plate member (24) and said first plate member having an extension (27) abutting against the second plate member (19) and entrains the latter when the first plate member (11) is pivoted past a specific angle with respect to the third plate member (24).

5. A coin guide as set forth in claim 3, including a guide edge (13) on the upper end of said first track surface (1) opposite said steep guide surface (4), and said guide edge (13) having a height measured from said first track surface (1) smaller than a height of said steep guide surface (4), and also smaller than the diameter of the coins to be inserted in the coin guide.

6. A coin guide as set forth in claim 3, in which said first track surface (1) forms an angle with said steep guide surface (4) of less than 90°.

7. A coin guide as set forth in claim 3, in which said first track surface (1) forms an angle with said steep guide surface (4) in the range of 80° to 85°.

8. A coin guide, having at least a first (1, 4) and a second runway (2, 5), being arranged in different directions, said first runway (1, 4) including a first track surface (1) and a steep guide surface (4) steeply inclined to the horizontal for supporting an inserted coin at its circumference and at one of its sides respectively, said first track surface (1) being inclined to the horizontal both in its longitudinal and in its lateral direction and having an upper and a lower longitudinal edge, said steep guide surface (4) extending along an upstream portion of said lower longitudinal edge of said first track surface (1) and defining a plane, said first track surface (1) and said steep guide surface (4) being arranged at an inclination and steepness respectively, such that the coin simultaneously rolls along the first track surface and slides along the guide surface, a transition area, at which a coin runs beyond a downstream portion of said lower longitudinal edge of said first track surface (1) and into said second runway (2, 5), a baffle surface (8) arranged at said transition area for changing the direction of a coin running from the first into the second runway (1, 4; 2, 5), the improvement comprising said baffle surface (8) having a front edge in alignment with said plane of said steep guide surface (4) and rearwardly of a longitudinal path of travel for the coins on said first track surface (1) defined by the upper and lower longitudinal edges on the upstream portion of said track surface (1), said baffle surface (8) extending rearwardly from said front edge and from said plane of said steep guide surface (4) in a direction away from said first runway (1, 4) and laterally of said second runway (2, 5), and said first runway (1, 4) having in a direction parallel to said steep guide surface (4) an open downstream end in alignment with the longitudinal path of travel for the coins, whereby a long straight line foreign body slipped along said first track surface (1) parallel to and abutting on the steep guide surface (4) can pass forwardly of and beyond the front edge of said baffle surface (8) and drop off an open downstream end of the first runway (1, 4) into a free space.

9. Coin guide according to claim 8, in which said second runway (2, 5) including a second track surface (2), the beginning of the second track surface (2) is arranged beside the end of the first track surface (1), and the steep guide surface (4) associated with the first track surface (1) is arranged on a side of the first track surface (1) facing the second track surface (2), and is spaced from the baffle surface (8) making it possible for a coin to pass over from the first (1) to the second track surface (2); and another guide surface (5) associated with the second track surface (2), said another guide surface (5) arranged on a side of the second track surface (2) facing away from the first track surface (1).

10. Coin guide according to claim 9, and said second track surface (2) leads into a steadying chamber (15) for coins, and a further track surface (3) leads from the steadying chamber (15) to a coin checking station (20, 21).

11. A coin guide as set forth in claim 8, including a guide edge (13) on an upstream portion of said upper longitudinal edge of said first track surface (1), and said guide edge (13) having a height measured from said first track surface (1) smaller than a height of said steep guide surface (4), and also smaller than the diameter of the coins to be inserted in the coin guide.

12. A coin guide as set forth in claim 8, in which said first track surface (1) forms an angle with said steep guide surface (4) of less than 90°.

13. A coin guide as set forth in claim 8, in which said first track surface (1) forms an angle with said steep guide surface (4) in the range of 80° to 85°.

* * * * *